US010717300B2

(12) United States Patent
Izawa et al.

(10) Patent No.: US 10,717,300 B2
(45) Date of Patent: Jul. 21, 2020

(54) INKJET PRINTER

(71) Applicant: MIYAKOSHI PRINTING MACHINERY CO., LTD., Narashino-shi, Chiba (JP)

(72) Inventors: Hideo Izawa, Narashino (JP); Seiji Komatsuda, Yokote (JP); Eiichi Tamura, Yokote (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 16/281,545

(22) Filed: Feb. 21, 2019

(65) Prior Publication Data

US 2020/0171847 A1 Jun. 4, 2020

(30) Foreign Application Priority Data

Dec. 4, 2018 (JP) ..... 2018-227702

(51) Int. Cl.

| | |
|---|---|
| ***B41J 11/00*** | (2006.01) |
| ***F26B 13/18*** | (2006.01) |
| ***F26B 3/28*** | (2006.01) |
| ***B41J 2/14*** | (2006.01) |

(52) U.S. Cl.

CPC ..... *B41J 11/002* (2013.01); *B41J 2/14* (2013.01); *F26B 3/283* (2013.01); *F26B 13/18* (2013.01)

(58) Field of Classification Search

CPC . B41J 11/002; B41J 2/14; F26B 3/283; F26B 13/18

See application file for complete search history.

(56) References Cited

U.S. PATENT DOCUMENTS

| | | | | |
|---|---|---|---|---|
| 8,251,505 | B2 * | 8/2012 | Hara | B41J 11/0015 347/101 |
| 8,596,777 | B2 | 12/2013 | Okamoto | |
| 8,646,893 | B2 | 2/2014 | Ramesh et al. | |
| 9,815,296 | B2 | 11/2017 | Mueller et al. | |

(Continued)

FOREIGN PATENT DOCUMENTS

| | | | |
|---|---|---|---|
| DE | 102016225090 | A1 | 7/2017 |
| EP | 3034310 | A1 | 6/2016 |
| EP | 3070533 | A1 | 9/2016 |

(Continued)

OTHER PUBLICATIONS

European Search Report for corresponding application No. 19158424.2, dated Aug. 29, 2019 (9 pages).

*Primary Examiner* — Huan H Tran

(74) *Attorney, Agent, or Firm* — Flynn Thiel, P.C.

(57) ABSTRACT

An inkjet printer capable of suppressing temperature unevenness of a drying drum itself as much as possible having a printing part for applying ink to a medium before printing, a drying drum for heating and drying a medium after printing having the ink applied in contact with an outer circumferential face thereof, and a controller capable of individually controlling heating of a plurality of sections obtained by dividing the drying drum along a plane perpendicular to a shaft direction thereof. Each of the respective sections is mounted with a heater part capable of heating the corresponding section, and heating of the heater parts of all of the sections is continuously controlled individually by the controller.

4 Claims, 7 Drawing Sheets

(56) References Cited

U.S. PATENT DOCUMENTS

| | | | | |
|---|---|---|---|---|
| 2011/0205321 | A1* | 8/2011 | Kobayashi | B41J 2/155<br>347/102 |
| 2019/0193426 | A1* | 6/2019 | Mizushima | B41J 11/002 |

FOREIGN PATENT DOCUMENTS

| | | | |
|---|---|---|---|
| JP | 2001-141364 | A | 5/2001 |
| JP | 2009-226755 | A | 10/2009 |
| JP | 2012-131065 | A | 7/2012 |
| JP | 2015-112543 | A | 6/2015 |
| JP | 2015-205476 | A | 11/2015 |
| WO | 01/31271 | A1 | 5/2001 |

* cited by examiner

INKJET PRINTER

TECHNICAL FIELD

The present invention relates to an inkjet printer, and more specifically relates to an inkjet printer provided with a controller for controlling making a temperature of a drying drum to a target temperature.

BACKGROUND ART

In the field of printing, a medium after printing obtained by performing an inkjet type of printing to a medium before printing is heated and dried by a heating apparatus.

At this time, in order to heat and dry the medium after printing efficiently, various heating controls are performed to the heating apparatus.

As such a heating control, for example, a PID control which is a kind of feedback control is known. The PID control controls an input value using three elements of a deviation between an output value and a target value, an integral thereof, and a differential thereof.

Further, as specific examples, are known a recording apparatus which performs a heater temperature control for controlling a value of current to be flown into a heater such that a heater temperature at which ink dries properly to achieve a high print quality can be obtained and which adopts a feedback control such as the PID control for the temperature control (for example, see PTL 1), a recording medium conveying apparatus which uses a PI control for controlling a calorific value to be applied by integrating a deviation (a residual deviation) between a target temperature and a actually measured temperature in a time axial direction, a PID control which further adds a change rate obtained by differentiating a change in actually measured temperature by time, or the like (for example, see PTL 2), a process liquid applying apparatus which determines a lighting duty ratio of a heater set at 0% to 100% from a difference (a proportional part) between a control target temperature and a current temperature in a certain fixed cycle in a period elapsing until printing is performed and performs, at a control part, a control such that a temperature of a heating roller reaches a target temperature by using the lighting duty ratio (for example, see PTL 3), an inkjet printer where a control part controls a first heater and a second heater based upon a detection temperature detected by a temperature sensor and adjusts a power of the second heater according to a difference between the detection temperature and a drying temperature (for example, see PTL4), and the like.

CITATION LIST

Patent Literature

PTL 1: Japanese Patent Application Laid-Open No. 2009-226755

PTL 2: Japanese Patent Application Laid-Open No. 2012-131065

PTL 3: Japanese Patent Application Laid-Open No. 2015-112543

PTL 4: Japanese Patent Application Laid-Open No. 2015-205476

SUMMARY OF INVENTION

Technical Problem

However, in the heating controls described in PTL 1 to PTL 4, temperatures of the heating apparatuses can be elevated efficiently, but occurrences of temperature unevenness cannot be suppressed in the heating apparatuses themselves.

Further, in the inkjet printer, since an amount of ink applied in a widthwise direction of a medium after printing is not necessarily constant, the problem is that a temperature of a portion of the heating apparatus for heating and drying a portion of the medium after printing having a large amount of ink applied is not sufficiently elevated as compared with temperatures of the other portions of the heating apparatus. As a result, the problem causes a drying failure.

The present invention has been made in view of the above-described circumstances, and an object thereof is to provide an inkjet printer capable of suppressing temperature unevenness of a drying drum itself which is the heating apparatus as much as possible.

Solution to Problems

As a result of intensive research, the present inventors have found that the above problem can be solved by dividing a drying drum into a plurality of sections and controlling heating of each section individually, and have completed the present invention.

The present invention lies in (1) an inkjet printer including a printing part for applying ink to a medium before printing, a drying drum for heating and drying a medium after printing having the ink applied in contact with an outer circumferential face of the drying drum, and a controller capable of individually controlling heating of a plurality of sections obtained by dividing the drying drum along a plane perpendicular to a shaft direction of the drying drum, wherein each of the sections is mounted with a heater part capable of heating the corresponding section, and heating of heating parts of all of the sections is continuously controlled individually by the controller.

The present invention lies in (2) the inkjet printer according to the above aspect (1) wherein the heating parts can heat the sections according to output ratios which are percentages of output capacities of the sections; each of the sections is further mounted with a temperature detecting part for detecting a temperature of the corresponding section individually; the controller has an initial output ratio setting part for setting an initial output ratio, a target temperature setting part for setting target temperatures of the plurality of sections, a storage part for storing an output increase/decrease operation expression and an output limitation operation expression, and an operation part for computing the output ratios sequentially based upon the output increase/decrease operation expression and the output limitation operation expression; the output increase/decrease operation expression is used to obtain an additional output ratio by multiplying by a coefficient set freely a temperature difference obtained by subtracting one of actually measured temperatures detected by the temperature detecting parts of the sections from an average temperature of the actually measured temperatures, and to add the additional output ratio to the initial output ratio of the corresponding section; the output limitation operation expression is used to adopt the output ratio having the additional output ratio added based upon the output increase/decrease operation expression as an updated output ratio if the output ratio is 100% or less, and to adopt the output ratio of 100% as an updated output ratio if the output ratio exceeds 100%; and by the controller, heating starts of the heater parts of the respective sections are controlled with the initial output ratio set freely, and heating of the heater parts of the respective sections after the heating starts is continuously controlled with the updated output ratio.

The present invention lies in (3) the inkjet printer according to above aspect (2) wherein the storage part further stores a PID operation expression therein; the operation part further computes the updated output ratio based upon the PID operation expression if the temperature difference between the actually measured temperature and the target temperature is within a predetermined temperature range defined freely; the PID operation expression is used to convert the updated output ratio into a PID output ratio based upon elements of a deviation between the actually measured temperature and the target temperature, an integral of the deviation, and a differential of the deviation; and by the controller, heating of the heater parts of the respective sections is continuously controlled with the PID output ratios.

The present invention lies in (4) the inkjet printer according to the above aspect (2) wherein the storage part further stores a PID operation expression and a gain UP operation expression therein; the operation part further operates the updated output ratio based upon the PID operation expression and the gain UP operation expression if the temperature difference between the actually measured temperature and the target temperature is within a predetermined temperature range defined freely; the PID operation expression is used to convert the updated output ratio into a PID output ratio based upon elements of a deviation between the actually measured temperature and the target temperature, an integral of the deviation, and a differential of the deviation; the gain UP operation expression is used to add a surplus output ratio obtained by subtracting the PID output ratio of each of the heater parts of the sections from the updated output ratio of the sections to the PID output ratio of the heater part of the section the actually measured temperature of which is low; the output limitation operation expression is used to adopt the PID output ratio having the surplus output ratio added based on the gain UP operation expression as an updated PID output ratio if the PID output ratio is 100% or less, and to adopt the output ratio of 100% as the updated PID output ratio if the output ratio exceeds 100%; and by the controller, heating of the heater parts of the respective sections is continuously controlled with the updated PID output ratio.

The present invention lies in (5) the inkjet printer according to the above aspect (1) wherein the printing part has a printing head of a line head type; and the heater part is a band heater or a rubber heater attached along an inner circumferential face of the drying drum.

Advantageous Effects of Invention

In the inkjet printer of the present invention, the drying drum is divided into a plurality of sections and the controller continuously controls heating of the heater parts of all the sections individually, so that temperature unevenness between the sections can be suppressed. As a result, the temperature of the entire drying drum can be elevated efficiently and uniformly.

Further, in the inkjet printer, regarding a widthwise direction of the heated body, the controller improves a degree of heating of the section of the drum which heats and dries a portion of the medium after printing having a large amount of ink applied as compared with the other sections, so that lowering of a temperature of the section as compared with temperatures of the other sections can be suppressed. As a result, occurrence of a drying failure of the medium after printing can be suppressed.

Further, for example, when a width of the medium after printing is small, it is also possible to turn off a power source of the band heater or the rubber heater attached to the section which does not contact with the medium after printing. Thereby, consumption of energy can be reduced. It is to be noted that, even in this case, the controller continuously controls heating of the heater parts of the sections having the power sources turned on, so that temperature uneven between the sections having the power sources turned on can be suppressed regardless of an influence of the section having the power source turned off.

Specifically, the heater parts are configured to be capable of heating the sections according to the output ratios, the controller controls heating starts of the heater parts of the sections with the initial output ratio set freely, and continuously controls heating of the heating parts of the respective sections after the heating start with the updated output ratios computed using the output increase/decrease operation expression and the output limitation operation expression, so that an output ratio in the heater part of the section having an actually measured temperature lower than an average temperature can be increased in the course of the actually measured temperature reaching the target temperature. Thereby, the actually measured temperature of the section having the actually measured temperature lower than the average temperature can be improved.

Further, at this time, the temperature unevenness is counteracted by simultaneously lowering, the output ratio in the heater part of the section having the actually measured temperature higher than the average temperature, and excellent energy efficiency is obtained.

In addition, when the output ratio is computed based upon the output increase/decrease operation expression, if the output ratio exceeds 100% formally, the output ratio is limited to 100% or less by the output limitation operation expression, so that the update output ratio does not exceed 100%. Therefore, a merit that occurrence of an error or the like can be suppressed is obtained.

In the inkjet printer of the present invention, if the temperature difference between the actually measured temperature and the target temperature is within a predetermined temperature range defined freely, heating of the heating parts of the respective sections is continuously controlled with the PID output ratio obtained by computing the updated output ratio using the PID operation expression, so that control can be performed efficiently when the actually measured temperature comes close to the target temperature. That is, when the temperature difference between the actually measured temperature and the target temperature is within a predetermined temperature range defined freely, the plurality of sections are already sufficiently heated, so that, by adopting the PID output ratio taking into consideration not only the output increase/decrease operation expression but also the PID operation expression which is a so-called proportional control, the output ratio in the heater part of the section the temperature difference between the actually measured temperature and the target temperature of which is small can be decreased, while the output ratio in the heater part of the section the temperature difference between the actually measured temperature and the target temperature of which is large can be increased. Thereby, the energy efficiency can be further improved.

Incidentally, the PID operation expression is an expression based upon a known PID control. It is to be noted that the PID control is a known control performed by three elements: proportional control P; integral control I; and differential control D.

In addition thereto, in the inkjet printer, if the temperature difference between the actually measured temperature and the target temperature is within a predetermined temperature range defined freely, heating of the heater parts of the respective sections is continuously controlled with an updated PID output ratio obtained by computing the PID output ratio using the gain UP operation expression, so that the surplus output ratio which is not being used can be used in addition to the PID output ratio of the heater part of the section the actually measured temperature of which is low. Thereby, temperature unevenness between the sections can be further suppressed. Further, since a time until the actually measured temperature reaches the target temperature can be shortened, the energy efficiency can be still further more improved.

Furthermore, similarly to the above-described matter, when the updated PID output ratio is computed based upon the gain UP operation expression, if the updated PID output ratio exceeds 100% formally, the output ratio is limited to 100% or less by the output limitation operation expression, so that the updated PID output ratio does not exceed 100%. Therefore, the merit that occurrence of an error or the like can be suppressed is obtained.

In the inkjet printer of the present invention, since, in a case where the printing part has a printing head of a line head type, the medium after printing can be conveyed faster than in a case where the printing part has a printing head of a serial head type, as described above, if a portion has a larger amount of ink applied, the temperature of the section corresponding to the portion can be elevated positively, otherwise a drying failure of the medium after printing may easily occur, so that occurrence of a drying failure can be suppressed.

Accordingly, when the printing part has the printing head of a line head type, the inkjet printer is extremely preferred since the inkjet printer can perform printing at high speed, and a drying failure can be suppressed.

Further, when the heating part is a band heater or a rubber heater attached to an inner circumferential face of the drying drum, the merit that the sections of the respective drying drum are easy to heat is obtained.

DESCRIPTION OF EMBODIMENTS

Figure 1:
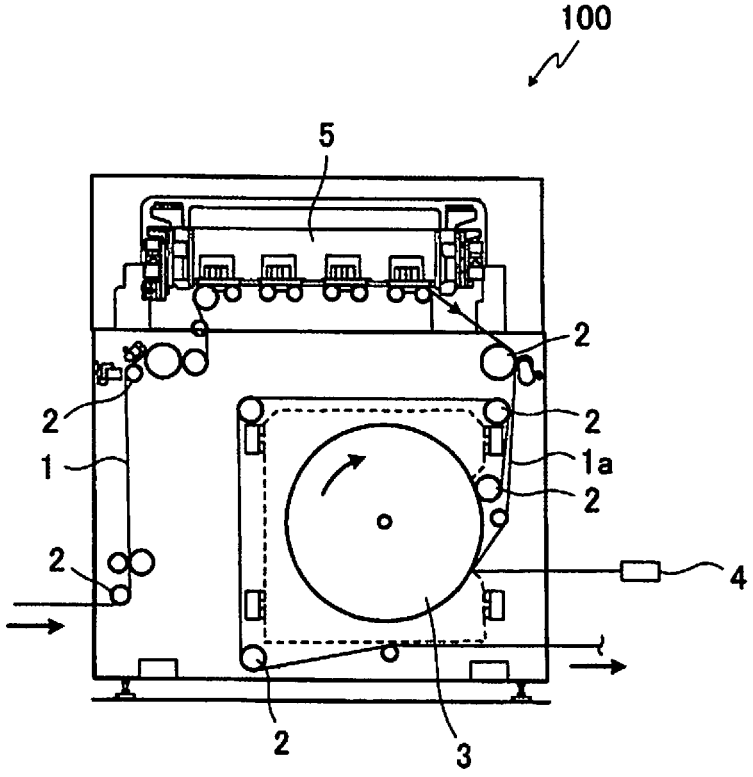
FIG. 1 is a schematic side view showing an embodiment of an inkjet printer according to the present invention.

A preferred embodiment of the present invention is described in detail below with reference to the drawings as necessary. It is to be noted that a same element is denoted by a same reference sign in the drawings and thus not repeatedly described. Further, a positional relationship such as up, down, left, right and the like is based upon a positional relationship shown in the drawings, unless otherwise noted. In addition, a size ratio of the drawing is not limited to a ratio shown in the drawing.

FIG. 1 is a schematic side view showing one embodiment of an inkjet printer according to the present invention.

As shown in FIG. 1, an inkjet printer 100 according to the present embodiment has a printing part 5 for applying ink to a medium before printing 1, a drying drum 3 for heating and drying a medium after printing 1*a* having the ink applied, a controller 4 capable of controlling heating of each of a plurality of sections obtained by dividing the drying drum 3 along planes perpendicular to a shaft direction of the drying drum 3, and a plurality of guide rolls 2 for guiding the medium before printing 1 or the medium after printing 1*a*.

In the inkjet printer 100, heating of heating parts of all of the sections can be continuously controlled by one controller 4 individually.

Here, the continuous control means control where control actions are performed temporarily continuously. Specifically, the continuous control means monitoring temperatures of sections 31*a*1, 31*a*2, and 31*a*3 constantly and controlling outputs thereof steplessly, respectively.

Thereby, in the inkjet printer 100, occurrence of temperature unevenness in the drying drum 3 itself can be suppressed. That is, it becomes possible to elevate the temperature of the entire drying drum 3 to a target temperature uniformly and efficiently.

Further, after the temperature of the drying drum 3 is elevated to the target temperature, such an event that the medium after printing 1*a* coming into contact with an outer circumferential face of the drying drum 3 causes partial non-elevation of the temperature can be prevented from occurring. As a result, occurrence of a drying failure of the medium after printing 1*a* can be suppressed.

In the inkjet printer 100, an elongated medium before printing 1 introduced from a paper feeding part (not shown) is guided by the guide rolls 2 and formed into the medium after printing 1*a* by applying ink thereto in a printing part 5.

Next, the medium after printing 1*a* is further guided by the guide rolls 2 to come into contact with the outer circumferential face of the drying drum 3 in a winding manner, so that the medium after printing 1*a* is heated and dried by the drying drum 3.

Then, the heated and dried medium after printing 1*a* is further guided by the guide rolls 2 to be recovered in a recovering part (not shown).

Here, as the medium before printing 1, for example, paper, fabric, non-woven fabric, a film, a metal foil, and the like can be adopted. It is to be noted that these media before printing may each have an ink receiving layer made from resin for receiving ink on a surface on an ink application side.

Further, the printing part 5 has a printing head of a line head type. That is, the inkjet printer 100 is of a system where a fixed printing head performs printing to the medium before printing 1 running. Therefore, while the medium before printing is being conveyed at high speed, inkjet printing can be performed thereto, and as described above, occurrence of a drying failure of the medium after printing can be suppressed.

Figure 2:
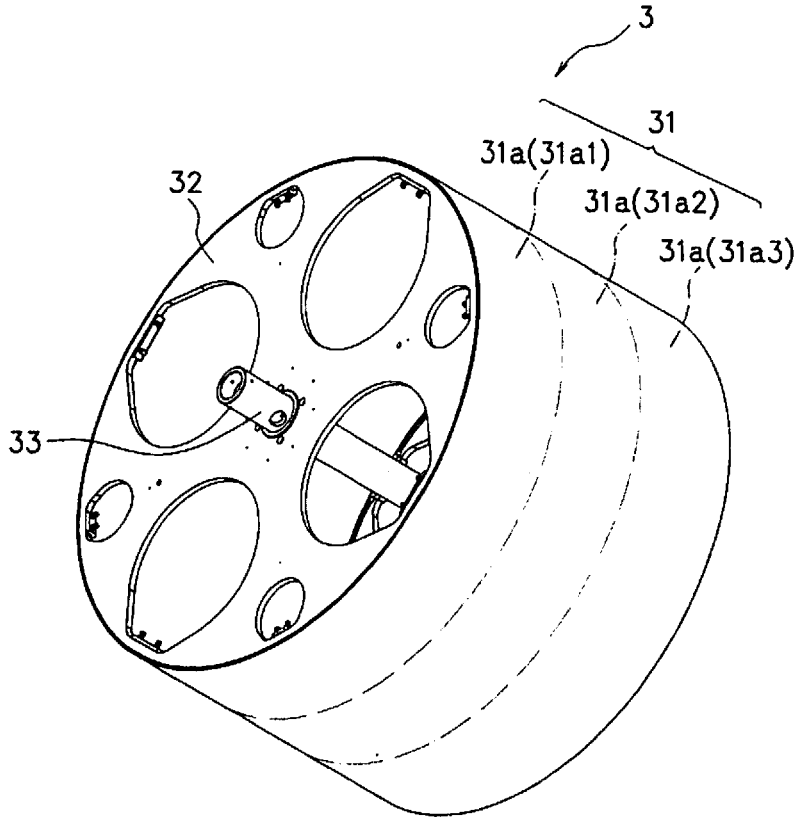
FIG. 2 is a perspective view showing a drying drum of the inkjet printer according to the present embodiment.

FIG. 2 is a perspective view showing a drying drum of the inkjet printer according to the present embodiment.

As shown in FIG. 2, the drying drum 3 is provided with a cylindrical main body portion 31, disk-shaped rim portions 32 attached to both sides of the main body portion 31, and a shaft 33 attached to the disk-shaped rim portions 32.

Further, in the drying drum 3, the main body portion 31, the rim portions 32 and the shaft 33 are integrated. That is, the rim portions 32 and the shaft 33 are also rotated by rotating the main body portion 31.

In the drying drum 3, the main body portion 31 is cylindrical and at least has the outer circumferential face configured to be heated.

Therefore, the medium after printing 1*a* is heated and dried by coming into contact with the outer circumferential face of the main body portion 31.

As a material of the main body portion 31, metal such as aluminum can be used.

An outer circumferential face of the main body portion 31 may be embossed using sand blast, shot blast, bead blast, or the like. In this case, when the medium after printing 1*a* and the outer circumferential face of the drying drum 3 (the main body portion 31) come into contact with each other, even if air comes in therebetween, the air can escape from gaps formed by the embossed face of the drying drum 3, so that close contact of the medium after printing 1*a* to the drum can be improved. As a result, lowering of a drying efficiency of the medium after printing 1*a* can be suppressed.

In the drying drum 3, the main body portion 31 is composed of three sections 31*a* obtained by dividing the drying drum 3 along planes perpendicular to a shaft direction of the drying drum 3. That is, in the inkjet printer 100, as described above, the drying drum 3 is divided into three sections 31*a* sectioned along the planes perpendicular to the shaft direction and heating of the respective sections 31*a* is controlled. It is to be noted that the three sections 31*a* are separated inside the drying drum 3, so that the sections 31*a* cannot be recognized from an appearance of the drying drum 3.

Figure 3:
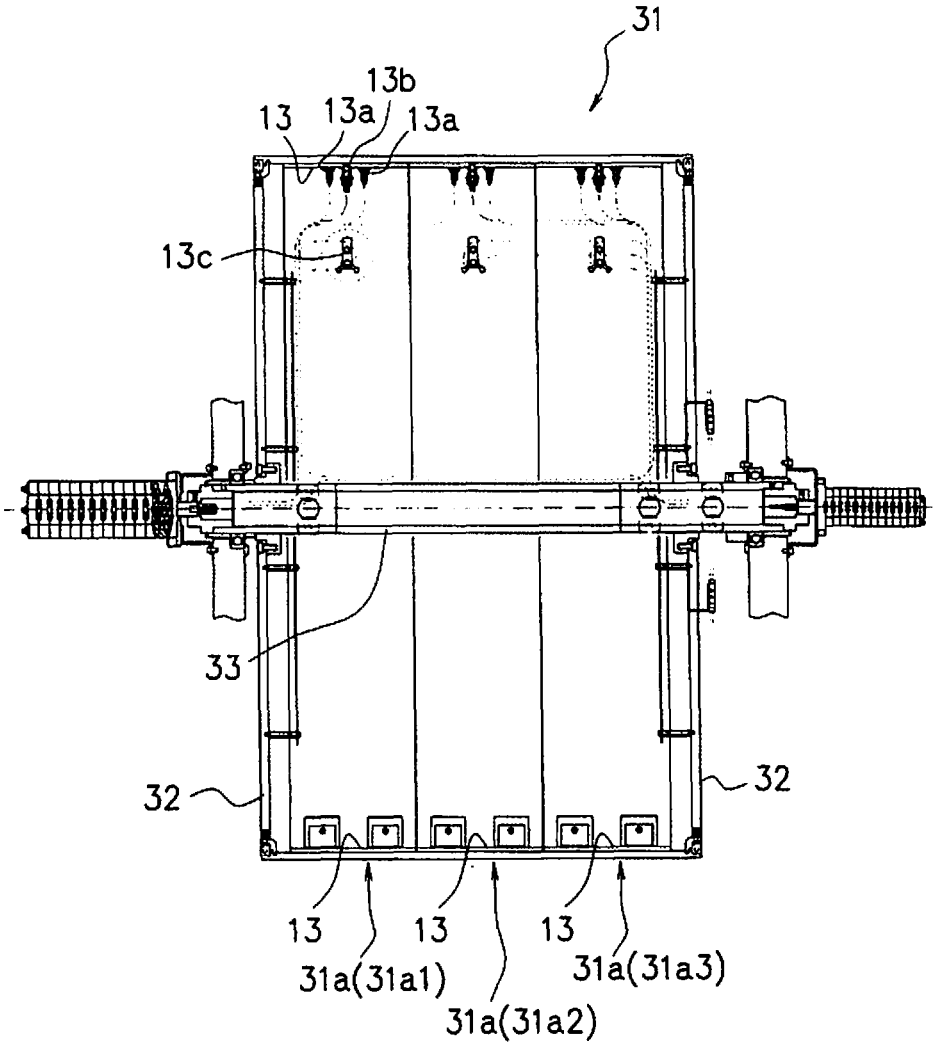
FIG. 3 is a horizontal sectional view of the drying drum of the inkjet printer according to the present embodiment.

FIG. 3 is a horizontal sectional view of the drying drum of the inkjet printer according to the present embodiment.

As shown in FIG. 3, in the drying drum 3, the sections 31*a* are each mounted with a heater part 13 capable of heating a corresponding section 31*a* according to an output ratio, a power supply terminal 13*a* of the corresponding heater part 13, a temperature detecting part 13*b* for detecting a temperature of the corresponding section 31*a*, and a thermostat 13*c* for shutting down power supply to the corresponding heater part 13 in the event of abnormal heating.

Here, in the inkjet printer 100 according to the present embodiment, as the heater part 13, a band heater or a rubber heater is adopted, and as the temperature detecting part 13*b*, a thermocouple is adopted.

Here, the term "output ratio" means a percentage of an output capacity. It is to be noted that a unit of the output ratio is % (percent). That is, when power is supplied to the heater part 13, a maximum output ratio in the heater part 13 is 100%, while a minimum output ratio therein is 0%.

It is to be noted that a phase of an AC power source is controlled to supply power to the heater part 13 in the inkjet printer 100. At this time by using a thyristor to change a ratio of ON time for each cycle of the AC current, adjustment of the output ratio is achieved.

The heater part 13 is attached to the inside of the main body portion 31 along an inner circumferential face of the main body portion 31.

Further, regarding the heater part 13, three heater parts 13 are provided in parallel in a widthwise direction of the drying drum 3 so as to correspond to the three sections 31*a* of the main body portion 31. That is, one heater part 13 (for example, the band heater or the rubber heater) is attached to each section 31*a*. Therefore, the respective sections 31*a* are heated independently by the heater parts 13 attached to the corresponding sections 31*a*, so that heating is performed by heat conduction from the inner circumferential face of the drying drum 3 to the outer circumferential face of the drying drum 3.

In addition, for example, when a width of the medium after printing 1*a* is small, it is also possible to turn off the power source of the heater part 13 attached to a section 13*a* which does not come into contact with the medium after printing 1*a*. Thereby, energy consumption can be reduced.

The thermocouple (the temperature detecting part 13*b*) is arranged so as to project within the corresponding heater part 13 from the heater part 13, and a detecting portion of the thermocouple abuts on the inner circumferential face of the main body portion 31 via a hole provided in the heater part 13. Thereby, the thermocouple can detect an actual temperature at that time (hereinafter, called "actually measured temperature") of the main body portion 31 of the corresponding section.

Returning to FIG. 1, in the inkjet printer 100, the controller 4 is connected to the heater parts 13 and the thermocouples (the temperature detecting parts 13*b*) of all of the sections 31*a* via a wired or wireless network.

The controller 4 is configured to be capable of receiving temperature signals of actually measured temperatures from the temperature detecting portions 13*b* of the respective sections 31*a* and transmitting output ratio signals of the output ratios to the heater parts 13.

Therefore, in the inkjet printer 100, heating of the heater parts 13 of the respective sections 31*a* can be simultaneously controlled by the controller 4.

Figure 4:
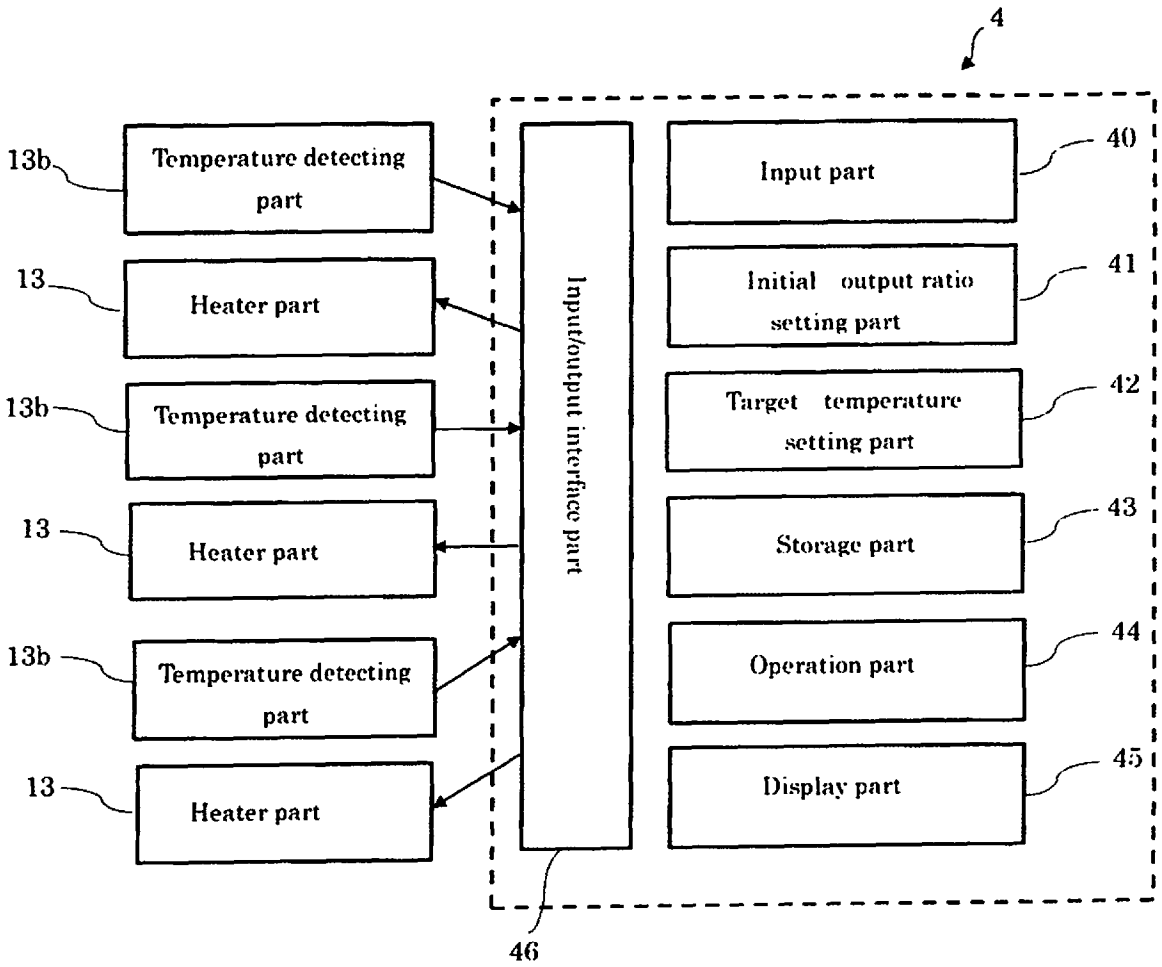
FIG. 4 is a block diagram for illustrating a controller of the inkjet printer according to the present embodiment.

FIG. 4 is a block diagram for illustrating the controller of the inkjet printer according to the present embodiment.

As shown in FIG. 4, the controller 4 has an input part 40, an initial output ratio setting part 41, a target temperature setting part 42, a storage part 43, an operation part 44, a display part 45, and an input/output interface part 46, and is therefore provided with a configuration as a so-called computer.

In the controller 4, Ethernet (registered trademark), a port or the like is appropriately used as the input/output interface part 46.

The input/output interface part 46 receives the temperature signals of the actually measured temperatures from the temperature detecting portions 13*b* and transmits the temperature signals to the storage part 43. It is to be noted that the actually measured temperatures are stored in the storage part 43.

Further, as described later, the input/output interface part 46 receives the output ratio signal of the output ratio (including an updated output radio or the like) computed by the operation part 44 and transmits the output ratio signal to the heater part 13.

The initial output ratio setting part 41 is used to set an initial output ratio, namely, an output ratio at a heating start time (an initial output ratio) via the input/output interface part 46 by operation through the input part 40.

Such an initial output ratio can be defined freely in a range of more than 0% and less than or equal to 100%. The initial output ratio is preferably in a range of 50% to 80% in view of the heating efficiency.

It is to be noted that the set initial output ratio is stored in the storage part 43.

The target temperature setting part 42 is used to set the target temperatures of the plurality of sections 31*a* via the input/output interface part 46 by operation through the input part 40.

Such a target temperature is common to the plurality of sections 31*a*, and can be set freely in a range which can heat and dry the medium after printing 1*a* sufficiently and which does not damage the medium after printing 1*a* or peripherals. When ink containing moisture is applied to the medium before printing 1, the target temperature is preferably in a range of 100° to 140°, more preferably in a range of 100° to 120° from a viewpoint of the drying efficiency.

It is to be noted that the set target temperature is stored in the storage part 43.

As the storage part 43, a memory such as RAM, ROM or the like is appropriately used.

Further, an operation program for computing the output ratio is stored in the storage part 43. Specifically, as the operation program, an output increase/decrease operation expression, an output limitation operation expression, a PID operation expression, and a gain UP operation expression are stored for controlling the output ratio in the storage part 43.

Here, the output increase/decrease operation expression obtains an additional output ratio by multiplying a temperature difference obtained by subtracting an actually measured temperature of a specific section 31*a* from an average temperature of actually measured temperatures detected by the temperature detecting parts 13*b* of the respective sections 31*a* by a coefficient set freely and adds the additional output ratio to an initial output ratio of the specific section 31*a*.

For example, when the respective sections 31*a* are assumed as a first section 31*a*1, a second section 31*a*2, and a third section 31*a*3, an actually measured temperature detected by the temperature detecting part 13*b* of the first section 31*a*1 is assumed as T1, an actually measured temperature detected by the temperature detecting part 13*b* of the second section 31*a*2 is assumed as T2, an actually measured temperature detected by the temperature detecting part 13*b* of the third section 31*a*3 is assumed as T3, the coefficient set freely is assumed as k, and the initial output ratio of the first section 31*a*1 is assumed as P %, and the output ratio computed in the first section 31*a*1 is assumed as Pz %, the output increase/decrease operation expression to the first section 31*a*1 is expressed as:

$$Pz=P+k((T1+T2+T3)/3-T1).$$

Thereby, in the output increase/decrease operation expression, if the actually measured temperature T1 is lower than the average temperature ((T1+T2+T3)/3), the additional output ratio obtained by multiplying the temperature difference by the coefficient becomes a positive value, so that the output ratio Pz obtained becomes larger than the initial output ratio P.

On the other hand, if the actually measured temperature T1 is higher than the average temperature ((T1+T2+T3)/3), the additional output ratio obtained by multiplying the temperature difference by the coefficient becomes a negative value, so that the output ratio Pz obtained becomes smaller than the initial output ratio P.

Further, if the average temperature ((T1+T2+T3)/3) and the actually measured temperature T1 are equal to each other, the additional output ratio becomes zero, so that the computed output ratio Pz becomes equal to the initial output ratio P.

It is to be noted that a specific example of the output increase/decrease operation expression in the first section 31*a*1 is shown here, but operations are also similarly performed regarding the second section 31*a*2 and the third section 31*a*3.

Further, in the output increase/decrease operation expression, the coefficient k is a positive integer and is judged based upon how large the variation in the temperature between the respective sections.

In this manner, in the inkjet printer 100, by the controller 4, the output ratio in the heater part 13 of the section 31*a* having the actually measured temperature lower than the average temperature can be increased, and the output ratio in the heater part 13 of the section 31*a* having the actually measured temperature higher than the average temperature can be decreased, so that the energy efficiency becomes excellent.

When the output ratio Pz to which the additional output ratio is added based upon the output increase/decrease operation expression is 100% or less, the output limitation operation expression adopts the output ratio as an updated output ratio, and when the output ratio Pz exceeds 100%, the output limitation operation expression adopts the output ratio of 100% as the updated output ratio. That is, in the controller 4, the output limitation operation expression prevents the updated output ratio from exceeding 100%, otherwise the output ratio Pz may formally exceed 100% as a result of addition of the additional output ratio to the initial output ratio P according to the output increase/decrease operation expression. Thereby, the inkjet printer 100 has a merit that occurrence of an error or the like can be suppressed.

The PID operation expression is an operation expression based upon a known PID control.

It is to be noted that the PID control is a control which is a combination of three actions: a proportional action (proportional gain) for controlling an output ratio in proportion to a deviation between an actually measured temperature and a target temperature; an integral action (integral gain) for performing control in proportional to an integral value of the deviation; and a differential action (differential gain) for performing control in proportional to a differential value of the deviation. It is to be noted that since the operation expressions of the proportional action, the integral action, and the differential action are known, explanation thereof is omitted.

In the controller 4, the updated output ratio computed according to the output limitation operation expression is further computed according to the PID operation expression to be converted to the PID output ratio.

In this manner, in the inkjet printer 100, since operation is performed by the controller 4 based upon not only the output increase/decrease operation expression but also the output PID operation expression, the output ratio of an output value in the heater part 13 of the section 31*a* having a small temperature difference between the actually measured temperature and the target temperature can be decreased, while the output ratio of an output value in the heater part 13 of the section 31*a* having a large temperature difference between the actually measured temperature and the target temperature can be increased. Therefore, particularly, when the plurality of sections 31*a* are in a sufficiently heated state, the energy efficiency becomes further excellent.

The gain UP operation expression is for adding a surplus output ratio obtained by subtracting the PID output ratios from the updated output ratios of the respective sections 31*a* to the PID output ratio of a section 31*a* having a low actually measured temperature.

For example, when the updated output ratios of the respective sections 31*a* are assumed as Pk1, Pk2, and Pk3, and the PID output ratios are assumed as PP1, PP2, and PP3, the surplus output ratio PY is expressed as:

$$PY=(Pk1-PP1)+(Pk2-PP2)+(Pk3-PP3).$$

Then, when the PID output ratio of the heater part 13 of the section 31*a* of the plurality of sections 31*a* having a low actually measured temperature is assumed as PP1 and the computed output ratio is assumed as PG %, the gain UP operation expression is expressed as $$PG=PP1+PY.$$

In this manner, in the inkjet printer 100, since the output ratio in the heater part 13 of the section 31*a* of the respective sections 31*a* having a low actually measured temperature can be increased by the controller 4, the temperature unevenness between the sections 31*a* can be suppressed.

Further, since a time elapsing until reaching the target temperature can be shortened, the energy efficiency becomes further more excellent.

In the controller 4, operation is performed again according to the above-described output limitation operation expression.

If the PID output ratio to which the surplus output ratio has been added based upon the gain UP operation expression is 100% or less, the output limitation operation expression adopts the PID output ratio as the updated PID output ratio, and if the PID output ratio exceeds 100%, the output limitation operation expression adopts the output ratio 100% as the updated PID output ratio. That is, in the controller 4, the output limitation operation expression prevents the updated PID output ratio from exceeding 100%, otherwise the output ratio may formally exceed 100% as a result of addition of the surplus output ratio to the PID output ratio at that time according to the gain UP operation expression.

Thereby, in the inkjet printer 100, occurrence of an error or the like can be suppressed.

As the operation part 44, a CPU (Central Processing Unit) or the like can be used. The operation part 44 performs operations according to a predetermined flow based upon the initial output ratio, the target temperature, the actually measured temperature, the output increase/decrease operation expression, the output limitation operation expression, the PID operation expression, the gain UP operation expression, and the like stored in the storage part 43.

Figure 5A:
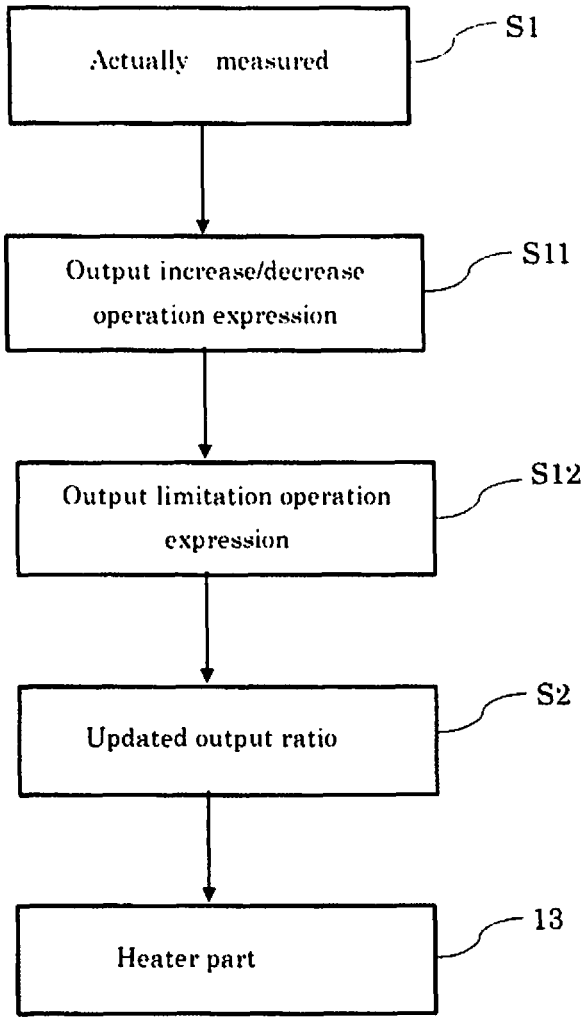
FIG. 5A is a block diagram for illustrating a flow where an operation part performs operation when a temperature difference between an actually measured temperature and a target temperature is not within a predetermined temperature range defined freely in the controller of the inkjet printer according to the present embodiment.
Figure 5B:
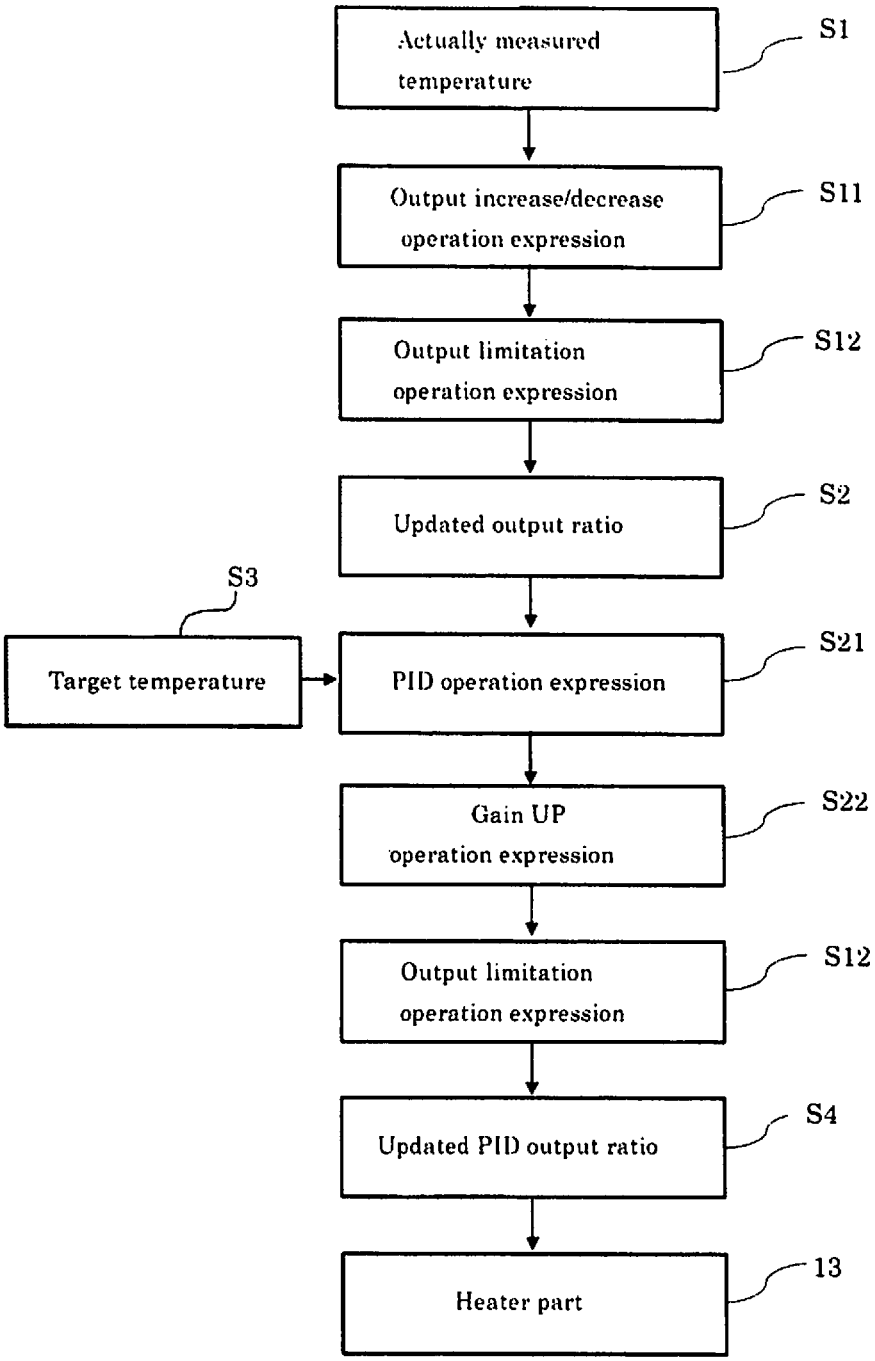
FIG. 5B is a block diagram for illustrating a flow for the operation part to perform operation when the temperature difference between an actually measured temperature and a target temperature is within the predetermined temperature range defined freely.

In the controller of the inkjet printer according to the present embodiment, FIG. 5A is a block diagram for illustrating a flow of operations performed by the operation part if the temperature difference between the actually measured temperature and the target temperature is not within a predetermined temperature range defined freely, and FIG. 5B is a block diagram for illustrating a flow of operations performed by the operation part if the temperature difference between the actually measured temperature and the target temperature is within the predetermined temperature range defined freely.

Here, the "within a predetermined temperature range defined freely" is appropriately set according to conditions such as the material of the medium after printing, a printing system of the printing part, the kind of the ink, the amount of ejection of the ink, and the like.

For example, when the medium after printing is continuous paper, and aqueous ink is printed by a printing head of a line head type, the temperature difference between the actually measured temperature and the target temperature is preferably within ±20°, and the temperature difference between the actually measured temperature and the target temperature is more preferably within ±10° from a viewpoint of the energy efficiency.

Incidentally, regarding whether or not the temperature difference between an actually measured temperature S1 and a target temperature S3 is within the predetermined temperature range defined freely, it does not matter whether or not the actually measured temperature S1 of the section 31*a* has reached the target temperature S3. That is, even after the actually measured temperature S1 of the section 31*a* has reached the target temperature S3, a case where the temperature difference between the actually measured temperature S1 of the section 31*a* and the target temperature S3 is within the predetermined temperature range defined freely is included therein.

In the controller 4, first of all, the heater parts 13 are heated at the initial output ratio.

Thereafter, heating of the heater parts 13 is controlled at the updated output ratios computed by the operation part 44.

As shown in FIG. 5A, in the controller 4, after heating is started and if the temperature difference between the actually measured temperature S 1 and the target temperature S3 is not within the predetermined temperature range defined freely, the operation part 44 performs operations of an output increase/decrease operation expression S11 and an output limitation operation expression S12 in this order using the actually measured temperature S1 to obtain the next updated output ratio S2.

Then, an output ratio signal of the next updated output ratio S2 is fed to the heater part 13 via the input/output interface part 46, and the heater part 13 is heated at the next updated output ratio S2.

In this manner, in the controller 4, if the temperature difference between the actually measured temperature S1 and the target temperature S3 is not within the predetermined temperature range defined freely, updating of the updated output ratio S2 is performed repeatedly. That is, the updating of the updated output ratios S2 of the heater parts 13 of the respective sections 31*a* is performed repeatedly by the controller 4 at the timing of an operation cycle of the operation unit.

Thereby, the temperatures of the respective sections 31*a* can be elevated so as to be equal to one another. In addition, if the temperature difference between the actually measured temperature S1 and the target temperature S3 is not within the predetermined temperature range defined freely, the energy efficiency becomes very excellent.

On the other hand, as shown in FIG. 5B, in the controller 4, after heating is started and if the temperature difference between the actually measured temperature S1 and the target temperature S3 is within the predetermined temperature range defined freely, the operation part 44 performs operations of the output increase/decrease operation expression S11 and the output limitation operation expression S12 in this order using the actually measured temperature S1, and further performs an operation of a PID operation expression S21 using a target temperature S3 to obtain a PID output ratio, and performs operations of a gain UP operation expression S22 and the output limitation operation expression S12 in this order to obtain an updated PID output ratio S4.

Then, an output ratio signal of the updated PID output ratio S4 is fed to the heater part 13 via the input/output interface part 46, and the heater part 13 is heated at the updated PID output ratio S4.

In this manner, in the controller 4, if the temperature difference between the actually measured temperature S1 and the target temperature S3 is within a predetermined temperature range defined freely, updating of the updated PID output ratio S4 is performed repeatedly. That is, updating of the updated PID output ratios S4 of the heater parts 13 of the respective sections 31*a* is performed repeatedly by the controller 4 at the timing of an operation cycle of the operation unit.

Thereby, the temperatures of the respective sections 31*a* can be elevated so as to be equal to one another. In addition, if the temperature difference between the actually measured temperature S1 and the target temperature S3 is within the predetermined temperature range defined freely, the energy efficiency becomes very excellent.

As the display part 45, a monitor or the like can be appropriately used.

In the controller 4, the actually measured temperatures S1 of the sections 31*a* and/or the output ratios of the respective sections 31*a* at that time are displayed on the display part 45. Thereby, the conditions of the sections 31*a* at that time can be confirmed.

As the input part 40, a keyboard, a mouse, or the like can be appropriately used.

In the controller 4, inputting for setting the above-described initial output ratio or target temperature is performed via the input part 40.

Further, as a part doubling as the display part 45 and the input part 40, a touch-type monitor (a touch screen) can also be adopted.

It is to be noted that the touch-type monitor is preferably adopted in view of convenience.

Next, a control flow of the respective sections 31*a* is described specifically.

Figure 6:
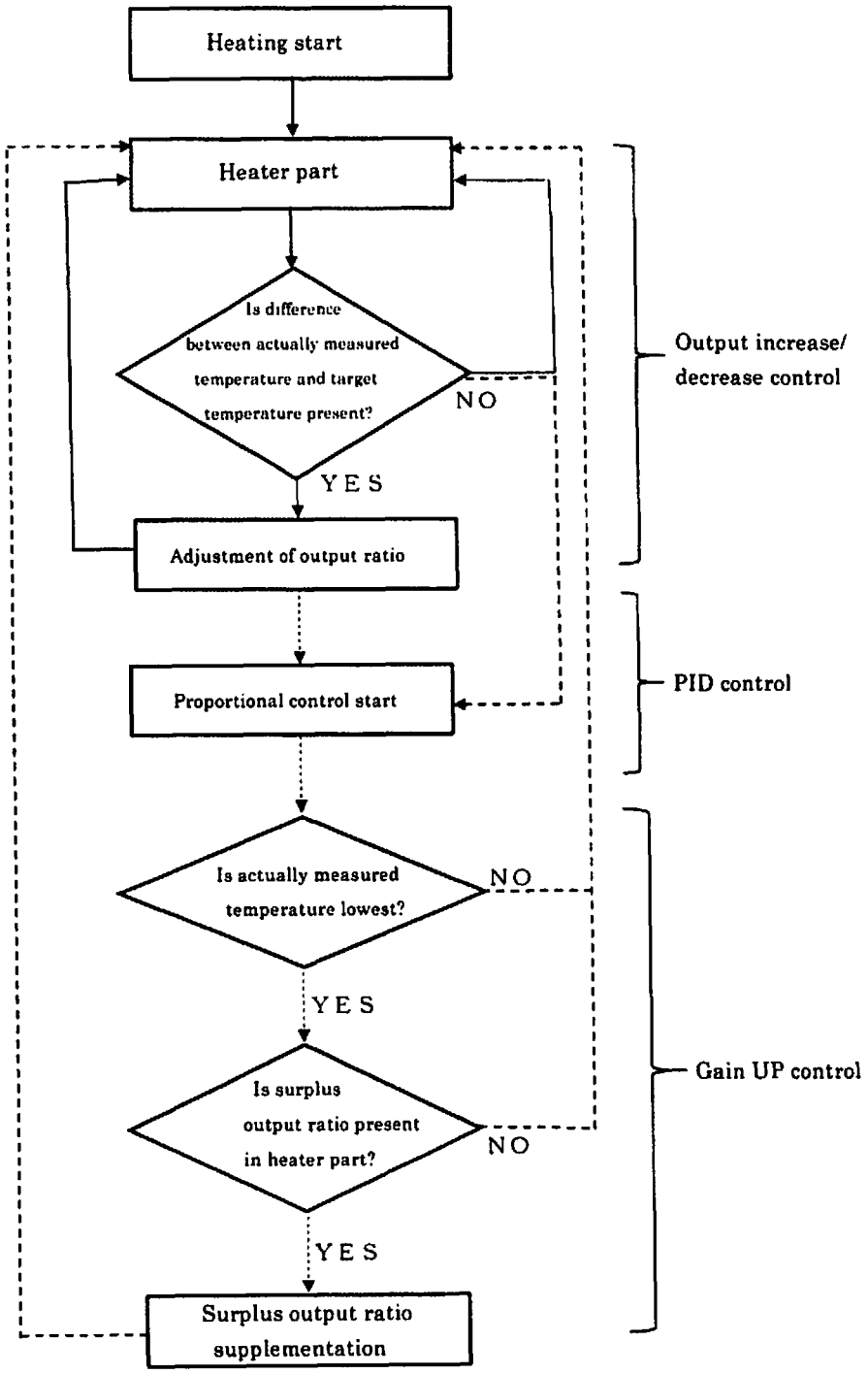
FIG. 6 is an illustrative diagram for illustrating a control flow of a heater part in the inkjet printer according to the present invention.

FIG. 6 is an illustrative diagram for illustrating a control flow of the heater part in the inkjet printer according to the present embodiment. It is to be noted that, in FIG. 6, a flow for a case where the temperature difference between the actually measured temperature S1 and the target temperature S3 is not within the predetermined temperature range defined freely is indicated by a solid line, while a flow for a case where the temperature difference between the actually measured temperature S1 and the target temperature S3 is within the predetermined temperature range defined freely is indicated by a broken line.

As shown in FIG. 6, in the inkjet printer 100, first of all, the controller 4 transmits an instruction to start heating with an initial output ratio to the heater part 13.

Thereby, the heater part 13 starts heating with the initial output ratio.

Next, if the temperature difference between the actually measured temperature S1 and the target temperature S3 is not within the predetermined temperature range defined freely, the controller 4 selects whether or not a temperature difference is present between the actually measured temperature S1 of the heater part 13 of each section 31*a* and the average temperature. It is to be noted that, if such a temperature difference is, for example, 11° C. or more, it is judged that the temperature difference is present.

Then, if it is judged that the temperature difference is present (YES), adjustment of the output ratio is performed by the output increase/decrease control based upon the output increase/decrease operation expression S11, and heating of the heating part 13 is performed with the updated output ratio S2 where the output ratio has been adjusted.

On the other hand, if it is judged that the temperature difference is absent (NO), adjustment of the output ratio is not performed, and heating of the heater part 13 is performed using the same output ratio as the updated output ratio S2.

It is to be noted that the updating of the output ratio is performed repeatedly by continuous control, as described above.

Next, if the temperature difference between the actually measured temperature S1 and the target temperature S3 is within the predetermined temperature range defined freely, the controller 4 selects whether or not the temperature difference is present between the actually measured temperature S1 of the heater part 13 of each section 31*a* and the average temperature.

Then, if it is judged that the temperature difference is present (YES), adjustment of the output ratio is performed by the output increase/decrease control, and the proportional control is started to the updated output ratio S2 where the adjustment of the output ratio has been performed, by PID control based upon the next PID operation expression S21.

On the other hand, if it is judged that the temperature difference is absent (NO), adjustment of the output ratio is not performed, and the proportional control is started to the same output ratio (the updated output ratio S2) by the next PID control.

Next, the controller 4 selects a section 31*a* having the lowest actually measured temperature S1 among the actually measured temperatures S1 of the heater parts 13 of the sections 31*a*.

Then, if it is judged that a specific section 31*a* has the lowest actually measured temperature S1 (YES), or if it is judged that whether the surplus output ratio is present or absent is selected in the heater part 13 of the section 31*a* and the surplus output ratio is present (YES), supplementation with the surplus output ratio is performed by the gain UP control based on the gain UP operation expression S22, and the heating of the heater part 13 is performed with the supplemented updated PID output ratio S4.

On the other hand, when it is not judged that a specific section 31*a* has the lowest actually measured temperature S1 (NO), or it is not judged that the surplus output ratio is present (NO), supplementation with the surplus output ratio is not performed, and heating of the heating part 13 is performed using an output ratio subjected to (a PID output ratio) the PID control as the updated PID output ratio S4.

It is to be noted that the updating of the output ratio is performed repeatedly by continuous control, as described above.

Though the preferred embodiment of the present invention has been described above, the present invention is not limited to the above-described embodiment.

In the inkjet printer 100 according to the present embodiment, the printing head of a line head type is used in the printing part, but a printing head of a serial head type can also be used therein.

In the inkjet printer 100 according to the present embodiment, the drying drum 3 is provided with the cylindrical main body portion 31, the disk-shaped rim portions 32 attached to the both ends of the main body portion 31, and the shaft 33 attached to the rim portions 32, but the structure of the drying drum 3 is not limited to this structure.

Further, in the drying drum 3, the main body portion 31 is composed of three sections 31*a* obtained by dividing the main body portion 31 along the planes perpendicular to the shaft direction, but the number of sections is not limited to this three.

In the inkjet printer 100 according to the present embodiment, the band heater or the rubber heater is adopted as the heater part 13, and the thermocouple is adopted as the temperature detecting part 13*b*, but the present invention is not limited thereto.

For example, as the temperature detecting part 13*b*, a non-contact type radiation temperature sensor or the like can be adopted instead of the thermocouple.

In the inkjet printer 100 according to the present embodiment, if the temperature difference between the actually measured temperature S1 and the target temperature S3 is not within the predetermined temperature range defined freely, as shown in FIG. 5A, the operation part 44 performs operations of the output increase/decrease operation expression S11 and the output limitation operation expression S12 in this order, and if the temperature difference between the actually measured temperature S1 and the target temperature S3 is within the predetermined temperature range defined freely, as shown in FIG. 5B, the operation part 44 performs operations of the output increase/decrease operation expression S11, the output limitation operation expression S12, the PID operation expression S21, the gain UP operation expression S22 and the output limitation operation expression S12 in this order, but the latter operations performed if the temperature difference between the actually measured temperature S1 and the target temperature S3 is within the predetermined temperature range defined freely is not necessarily essential. That is, regardless of whether or not the temperature difference between the actually measured temperature S1 and the target temperature S3 is within the predetermined temperature range defined freely, heating of the heating part may be continuously controlled only by the flow shown in FIG. 5A where the operation part 44 performs operations of the output increase/decrease operation expression S11 and the output limitation operation expression S12 in this order.

In the inkjet printer 100 according to the present embodiment, operations are performed according to the plurality of operation expressions described above, but another operation expression may be included unless these expressions are obstructed.

INDUSTRIAL APPLICABILITY

The inkjet printer 100 of the present invention can be utilized as an inkjet printer for performing printing to a medium before printing according to an inkjet system.

According to the inkjet printer 100 of the present invention, temperature unevenness of the drying drum itself can be suppressed as much as possible.

REFERENCE SIGNS LIST

1 . . . medium before printing,
100 . . . inkjet printer,
13 . . . heater part,
13*a* . . . power supply terminal,
13*b* . . . temperature detecting part,
13*c* . . . thermostat,
1*a* . . . medium after printing,
2 . . . guide roll,
3 . . . drying drum,
31 . . . main body portion,
31*a* . . . section,
31*a*1 . . . first section (section),
31*a*2 . . . second section (section),
31*a*3 . . . third section (section),
32 . . . rim portion,
33 . . . shaft,
4 . . . controller,
40 . . . input part,
41 . . . initial output ratio setting part,
42 . . . target temperature setting part,
43 . . . storage part,
44 . . . operation part,
45 . . . display part,
46 . . . input/output interface part, and
5 . . . printing part

The invention claimed is:

1. An inkjet printer comprising a printing part for applying ink to a medium before printing, a drying drum for heating and drying the medium after printing having the ink applied in contact with an outer circumferential face of the drying drum, and a controller capable of individually controlling heating of a plurality of sections obtained by dividing the drying drum along a plane perpendicular to a shaft direction of the drying drum, wherein each of the sections is mounted with a heater part capable of heating the corresponding section and heating of the heater parts of all of the sections is continuously controlled individually by the controller;

the heating parts can heat the sections according to output ratios which are percentages of output capacities of the sections;

each of the sections is further mounted with a temperature detecting part for detecting a temperature of the corresponding section individually;

the controller has an initial output ratio setting part for setting an initial output ratio, a target temperature setting part for setting target temperatures of the plurality of sections, a storage part for storing an output increase/decrease operation expression and an output limitation operation expression, and an operation part for computing the output ratios sequentially based upon the output increase/decrease operation expression and the output limitation operation expression;

the output increase/decrease operation expression is used to obtain an additional output ratio by multiplying by a coefficient set freely by a temperature difference obtained by subtracting an actually measured temperature detected by the temperature detecting parts of the sections from an average temperature of the actually measured temperatures, and adding the additional output ratio to the initial output ratio of the corresponding section;

the output limitation operation expression is used to adopt the output ratio having the additional output ratio added based upon the output increase/decrease operation expression as an updated output ratio if the output ratio is 100% or less, and to adopt the output ratio of 100% as an updated output ratio if the output ratio exceeds 100%; and by the controller, heating starts of the heater parts of the respective sections are controlled with the initial output ratio set freely, and heating of the heater parts of the respective sections after the heating starts is continuously controlled with the updated output ratio.

2. An inkjet printer according to claim 1, wherein the storage part further stores a PID operation expression therein;

the operation part further computes the updated output ratio based upon the PID operation expression if the temperature difference between the actually measured temperature and the target temperature is within a predetermined temperature range defined freely;

the PID operation expression is used to convert the updated output ratio into a PID output ratio based upon elements of a deviation between the actually measured temperature and the target temperature, an integral of the deviation, and a differential of the deviation; and by the controller, heating of the heater parts of the respective sections is continuously controlled with the PID output ratios.

3. An inkjet printer according to claim 1, wherein the storage part further stores a PID operation expression and a gain UP operation expression therein;

the operation part further operates the updated output ratio based upon the PID operation expression and the gain UP operation expression if the temperature difference between the actually measured temperature and the target temperature is within a predetermined temperature range defined freely;

the PID operation expression is used to convert the updated output ratio into a PID output ratio based upon elements of a deviation between the actually measured temperature and the target temperature, an integral of the deviation, and a differential of the deviation;

the gain UP operation expression is used to add a surplus output ratio obtained by subtracting the PID output ratio of each of the heater parts of the sections from the updated output ratio of the sections to the PID output ratio of the heater part of the section the actually measured temperature of which is low;

the output limitation operation expression is used to adopt the PID output ratio having the surplus output ratio added based on the gain UP operation expression as an updated PID output ratio if the PID output ratio is 100% or less, and to adopt the output ratio of 100% as the updated PID output ratio if the updated PID output ratio exceeds 100%; and by the controller, heating of the heater parts of the respective sections is continuously controlled with the updated PID output ratio.

4. An inkjet printer according to claim 1, wherein the printing part has a printing head of a line head type; and the heater part is a band heater or a rubber heater attached along an inner circumferential face of the drying drum.

* * * * *